US006309189B1

(12) United States Patent
Rey-Mermet et al.

(10) Patent No.: US 6,309,189 B1
(45) Date of Patent: Oct. 30, 2001

(54) MICROPUMP WITH A BUILT-IN INTERMEDIATE PART

(75) Inventors: Gilles Rey-Mermet, Monthey; Harald Van Lintel, Lausanne; Didier Maillefer, Belmont, all of (CH)

(73) Assignee: Westonbridge International Limited, Dublin (IR)

( * ) Notice: Subject to any disclaimer, the term of this patent is extended or adjusted under 35 U.S.C. 154(b) by 0 days.

(21) Appl. No.: 09/331,952

(22) PCT Filed: Dec. 19, 1997

(86) PCT No.: PCT/EP97/07278

§ 371 Date: Jun. 28, 1999

§ 102(e) Date: Jun. 28, 1999

(87) PCT Pub. No.: WO98/29661

PCT Pub. Date: Jul. 9, 1998

(30) Foreign Application Priority Data

Dec. 31, 1996 (FR) ..... 96 16278

(51) Int. Cl.[7] ..... F04B 17/00
(52) U.S. Cl. ..... 417/413.3
(58) Field of Search ..... 417/413.3, 413.1, 417/412, 321, 322, 410.2, 410.1

(56) References Cited

U.S. PATENT DOCUMENTS 5,085,562 * 2/1992 Van Lintel ..... 417/413.3
5,096,388 * 3/1992 Weinberg ..... 417/413.3
5,180,288 * 1/1993 Richter et al. ..... 417/48
5,961,298 * 10/1999 Bar-Cohen et al. ..... 417/322
6,116,863 * 9/2000 Ahn et al. ..... 417/322

FOREIGN PATENT DOCUMENTS 44 22 972 1/1996 (DE) .
465 229 1/1992 (EP) .
WO 95/18307 7/1995 (WO) .
WO 95/19502 7/1995 (WO) .

* cited by examiner

*Primary Examiner*—Teresa Walberg
*Assistant Examiner*—Daniel Robinson
(74) *Attorney, Agent, or Firm*—Wolf, Greenfield & Sacks, P.C.

(57) ABSTRACT

A micropump including at least one main plate (1), at least one upper plate (2), and a middle plate (3) arranged between the other two plates (1, 2) and forming a pumping chamber (4) that is connected with at least one inlet of the micropump and at least one outlet of the micropump. The pumping chamber comprises a movable wall (5) machined into the middle plate (3); the upper plate is equipped with at least one opening (12) linking a cavity (8) with at least one portion of the movable wall (5). Actuation devices (6, 7, 13) attached to the free surface of the upper plate (2) are used to shift said movable wall (5) in order to bring about a periodic variation in the volume of the pumping chamber (4). According to the invention, the actuating devices (6, 7, 13) are formed by an actuating plate (7) of a material which can be machined so as to define a movable area (11) and said cavity (8). A (sic) intermediate part (13), formed from the upper plate (2), is fastened to the actuating plate (7) (sic) so as to establish contact with the movable wall (5).

25 Claims, 3 Drawing Sheets

MICROPUMP WITH A BUILT-IN INTERMEDIATE PART

The invention relates to a micropump and to its process of manufacture, this micropump comprising at least one base plate, at least one upper plate and an intermediate plate interposed between the other two plates and made of a material capable of being machined so as to define a pumping chamber, at least one fluid inlet control member for connecting the pumping chamber with at least one inlet of the micropump, and at least one fluid outlet control member for connecting the pumping chamber with at least one outlet of the micropump, the pumping chamber comprising a movable wall machined in the intermediate plate, said movable wall being capable of moving in two opposite directions during suction or delivery of said fluid in the pumping chamber, the upper plate being provided with at least one opening linking a cavity with at least one portion of the movable wall, actuation means fixed on the free face of the upper plate being provided to displace said movable wall in order to bring about a periodic variation of the volume of the pumping chamber.

In certain micropumps of the prior art, which are called "PIN-TYPE", one of the elements of the actuation means is constituted by an intermediate part which is intended to place the piezoelectric device in contact with the movable wall of the pumping chamber. Manufacture of this intermediate part by micro-machining and its assembly in the micropump device require high precision in order to obtain a micropump which operates reliably and regularly.

Such a micropump is described for example in International Application WO 9518307 to the firm WESTON-BRIDGE. FIG. 1 shows one of the embodiments of the micropump described in the document mentioned above. This micropump comprises a base plate 82, an intermediate plate 86, an upper plate 88, actuation elements 87 intended to cooperate with the piezoelectric device 80 and an intermediate part 84 in the form of a drawing pin connected by its flat head to the actuation elements 87.

It will be understood that the use of such an intermediate part 84, necessary for correct operation of the micropump, brings about considerable complications when this micropump is manufactured.

The object of the present invention is to provide a micropump presenting an intermediate part whose manufacture is simplified while making it possible to obtain a micropump functioning reliably and constantly.

In accordance with the invention, this object is attained thanks to the fact that the actuation means are formed by an actuating plate constituted by a material capable of being machined so as to define a movable area and said cavity, an intermediate part obtained from the upper plate being fixed on the actuating plate so as to establish contact with the movable wall.

It will be understood that manufacture of the intermediate part from the upper plate avoids manufacturing the intermediate part independently of all the other elements of the micropump, with the result that this intermediate part is perfectly integrated in the micropump, as will be explained hereinbelow.

The invention will be more readily understood and secondary characteristics and their advantages will appear in the course of the description of two embodiments given hereinafter by way of example.

Reference will be made to the accompanying drawings, in which:

FIG. 1, described hereinabove, shows a micropump of the prior art in section.

FIG. 2 schematically and partially shows, in section, a first embodiment of the micropump according to the invention.

Figure 1:
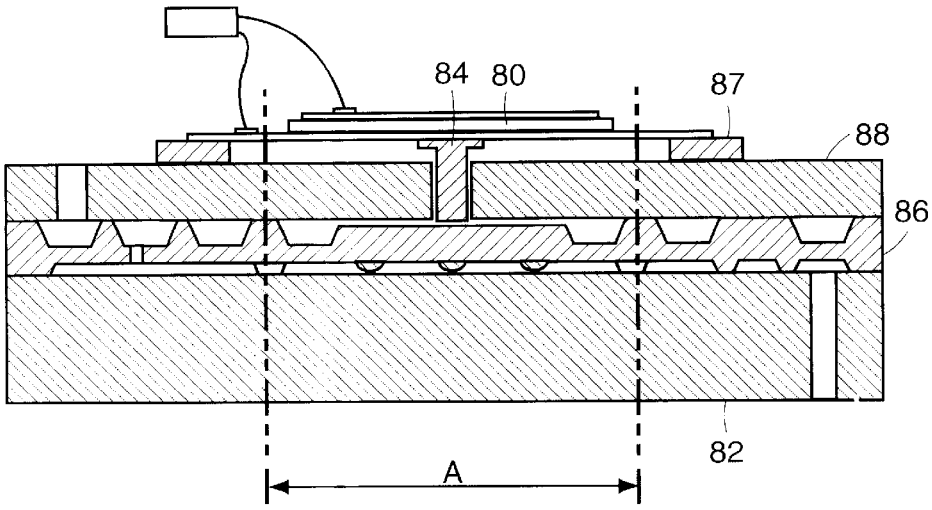
FIG. 1 PRIOR ART
Figure 2:
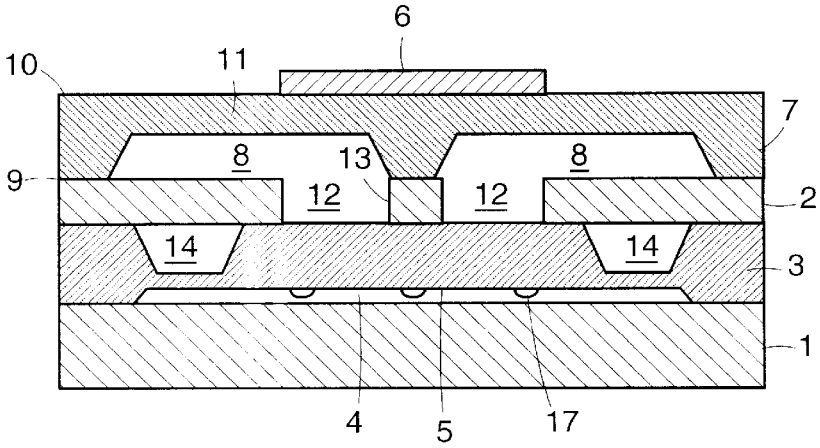
Figure 3:
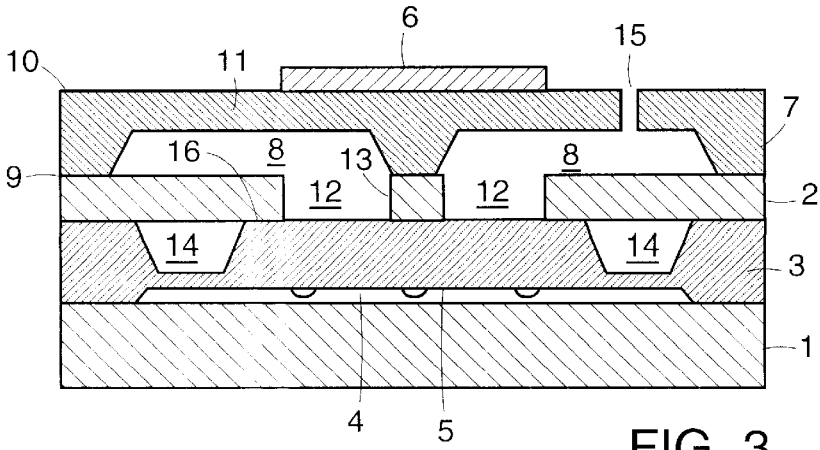
FIG. 3 is a Figure similar to FIG. 2, showing a second embodiment of the micropump according to the invention.

The partial and schematic sections of the two preferred embodiments of a micropump of this invention as illustrated in FIGS. 2 and 3 show solely the central part of a micropump such as that shown as zone A of FIG. 1.

With reference to FIG. 2, the central part of this micropump comprises a base plate 1 and an upper plate 2 which are preferably made of glass such as Pyrex. Between these two plates 1 and 2, is interposed the intermediate plate 3 which defines, with the base plate 1, the pumping chamber 4. The central portion of the intermediate plate 3 constitutes a mobile wall 5 intended to allow the variation of the volume of the pumping chamber 4 under the action of a piezoelectric device 6 surmounting the micropump.

An actuating plate 7 is interposed and fixed between the piezoelectric device 6 and the upper plate 2, creating a cavity 8 between the actuating plate 7 and the upper plate 2.

A free face 9 of the upper plate 2 is fixed, preferably by anodic welding, to a portion of the actuating plate 7, on either side of the cavity 8. On the side opposite the cavity 8, the free face 10 of the actuating plate 7 is connected to the piezoelectric device, in line with the central part of the cavity 8. Between the piezoelectric device 6 and the central portion of the cavity 8, the central portion of the actuating plate 7 constitutes a movable area 11.

The cavity 8 extends at the level of the upper plate 2 by an annular linking opening 12 surrounding an intermediate part 13 made from the same original piece as the upper plate 2.

The cavity 8 also presents an annular shape and surrounds a portion of movable area 11 fixed to the intermediate part 13. On the periphery of the linking opening 12, the upper plate 2 is in simple contact, without fixation, with the movable wall 5 (area 16 forming stop) so as to block any movement of the movable wall 5 beyond this zone of contact. Such fixation is preferably avoided thanks to an insulating layer covering the area 16 forming stop of the upper plate 2, this layer being, for example, made of silicon oxide.

An annular intermediate cavity 14 between the upper plate 2 and the intermediate plate 3 is also distinguished, this intermediate cavity issuing from the removal of material of the intermediate plate 3, located in line with a portion of the cavity 8, on the other side of the upper plate 2, and placed outside with respect to the linking opening 12.

In the same way as the area 16 forming stop limits the ascending movement of the movable wall 5, stops 17, fixed on the face of the movable wall 5 located opposite the pumping chamber 4, limit the descending movement of the movable wall 5.

It should be noted that the upper plate 2 and the intermediate plate 3 are fixed to each other, preferably by anodic welding in the contact areas located outside with respect to the intermediate cavity 14. The intermediate (3) and actuating (7) plates are preferably constituted by a semiconductor such as silicon The actuating means, composed in particular of the piezoelectric device 6, the intermediate part 13 and the movable wall 5 are preferably centred around the same axis.

As the intermediate part 13 and the upper plate 2 come from the same initial plate, it will be understood that manufacture of the micropump device is considerably simplified, that the problems of tolerance and compatibility between the different elements constituting this micropump are considerably minimized, and even eliminated. In effect, the thickness of the intermediate part 13 being forcibly identical to the thickness of the upper plate 2, during assembly, adjustment between the parts of the micropump device is then possible with a high degree of precision.

The first preferred embodiment illustrated in FIG. 2 provides that the intermediate plate 3 and the actuating plate 7 delimit a tight space, composed of the cavity 8, the linking opening 12 and the intermediate cavity 14, a partial vacuum being able to be established within this tight space.

Tightness of the above-mentioned space is rendered possible by the very high precision adjustment between the parts composing the micropump (movable area 11 of the actuating plate 7, upper plate 2, intermediate part 13, and movable wall 5). The strictly identical nature between the thickness of the intermediate part 13 and the upper plate 2 is a very important characteristic for obtaining a good adjustment between the parts, this allowing the tightness of the space mentioned above.

According to an advantageous characteristic, the presence of a partial vacuum in the tight space 8, 12, 14 makes it possible to draw the movable wall 5 of the pumping chamber 4 in the direction of the upper plate 2.

If a partial vacuum is established in the tight space 8, 12, 14, it is preferable not to fasten the intermediate part 13 to the movable wall 5 in order not to create residual stresses at the level of such fixation.

According to a second preferred embodiment shown in FIG. 3, the tight space 8, 12, 14 cannot be placed under partial vacuum but a conduit 15 connects this tight space to the outside of the micropump. This conduit 15 is preferably made in the upper part of the actuating plate 7 and communicates with the cavity 8, connecting the latter with the outside of the part of the micropump shown in FIG. 3, so that the space defined hereinabove presents a pressure equal to that of the outer space in which the conduit 15 opens out, this pressure being able to be atmospheric pressure.

Where a conduit 15 connecting the tight space 8, 12, 14 with the outside of the pump is provided, if it is desired to draw the movable wall 5 in the direction of the piezoelectric device 6, it is necessary to fasten the intermediate part 13 to the movable wall 5, such fixation being able to be effected by anodic welding.

Three preferred processes for manufacturing a micropump according to the invention as has been described hereinbefore will now be presented.

Whatever the process of manufacture among the three processes which will be presented, it is firstly necessary to finish an actuating plate 7, an upper plate 2, an actuation device and an intermediate plate 3/base plate 1 assembly in which the intermediate plate 3 is fixed to the base plate 1, a pumping chamber 4 being formed between these two plates, for example by prior machining of the intermediate plate 3.

In accordance with a first process of manufacturing a micropump according to the invention, the following steps are carried out:

a) machining of the actuating plate 7 so as to create the cavity 8, b) fastening of the actuating plate 7 to the upper plate 2, c) machining of the upper plate 2 so as to create the linking opening 12 and the intermediate part 13, d) fastening of the upper plate 2/actuating plate 7 assembly to the intermediate plate 3/base plate 1 assembly, and e) fastening of an actuation device, such as a piezoelectric one 6, to the actuating plate 7.

A solution favourable so much to the technique of manufacture provides, in the case of the first process of manufacture, that the machining of the linking opening 12 is obtained by electro-erosive machining or EDM (Electro Discharge Machining) process, by ultrasonic machining or UD (Ultrasonic Drilling) process or by chemical attack of the glass.

According to a second process of manufacturing a micropump, it is possible, by machining the linking opening 12 and the intermediate part 13 in two steps, to obtain a better precision on the sizes of the different elements of the micropump in order that the functioning thereof is more reliable.

In accordance with this second process of manufacture, the following steps are carried out:

a) machining of the actuating plate 7 so as to create the cavity 8, b) machining of the upper plate 2 so as to partially create the linking opening 12 and the intermediate part 13, c) fastening of the actuating plate 7 to the upper plate 2, d) machining of the upper plate 2 so as to terminate creation of the linking opening 12 and the intermediate part 13, e) fastening of the upper plate 2/actuating plate 7 assembly to the intermediate plate 3/base plate 1 assembly, and f) fastening of an actuation device, such as a piezoelectric one 6, to the actuating plate 7.

Here it is advantageously possible that the partial machining of the upper plate 2 is effected by electro-erosive machining (EDM) process or by ultrasonic machining (UD) process.

Furthermore, it is possible that the creation of the linking opening 12 and the intermediate part 13 be terminated by chemical attack of the upper plate 2.

On the other hand, as is illustrated in FIGS. 4A to 4D, within the framework of the second process for manufacturing the micropump, it is possible to deposit one or more metal layers on a face of the upper plate 2 before starting the creation of the linking opening 12 and of the intermediate part 13 (step b) by machining this face. In fact, the metal layer or layers may be located on one or the other of the two faces of the upper plate 2: on the face undergoing the partial creation of the opening 12 and the part 13 or on the machined face when the creation of this opening is terminated but in any case said metal layer or layers are on the side opposite the actuating plate 7.

Figure 4A:
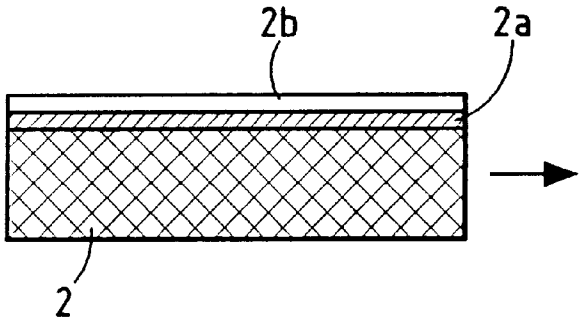
FIGS. 4A to 4D show certain steps of manufacturing a micropump in accordance with a preferential process of manufacture.
Figure 4B:
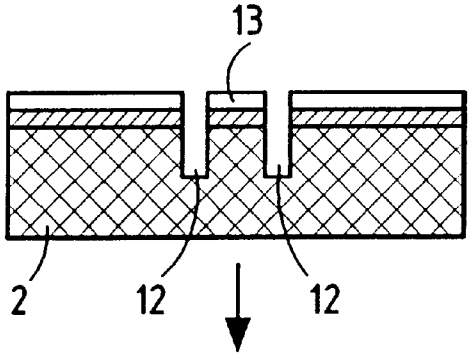
Figure 4D:
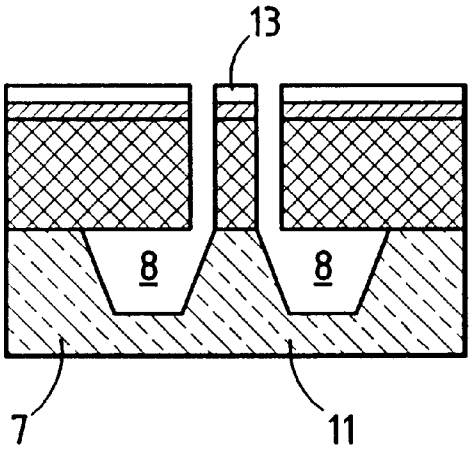
Figure 4C:
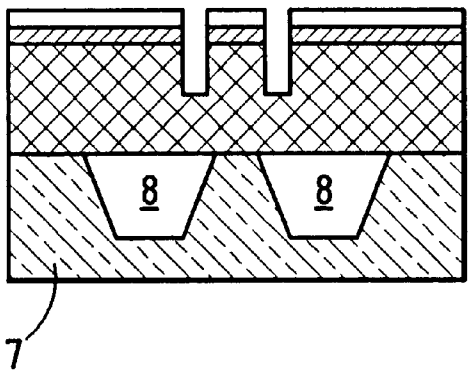

As illustrated in FIG. 4A, a layer of chromium 2*a*, followed by a layer of copper 2*b*, are deposited on the upper plate 2. Then (FIG. 4B), the upper plate 2 is machined so as to partially create the linking opening 12 of the intermediate part 13, such partial machining not bearing on the whole thickness of the upper plate 2. As is seen in FIG. 4C which corresponds to step c) of the second process of manufacture, the actuating plate 7, already machined and presenting cavity 8, is fixed to the upper plate 2, for example by anodic welding on the side opposite that bearing the metal layers. FIG. 4D illustrates step d) of the second process of manufacture and shows that an additional machining of the upper plate 2 makes it possible to terminate the creation of the annular linking opening 12 surrounding the intermediate part 13, with the result that the linking opening 12 communicates with the cavity 8 and the intermediate part 13 is fast with the actuating plate 7 at the level of the central area of the movable area 11.

A third process for manufacturing a micropump making it possible to minimize the tolerances of thickness, particularly at the level of the upper plate 2 and the intermediate part 13, will now be presented in relation with FIGS. 5A to 5F.

Figure 5A:
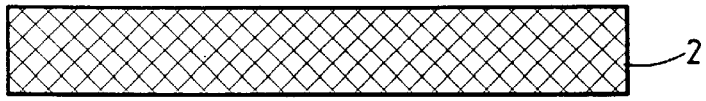
FIGS. 5A to 5F show the different steps of the process of manufacture of a micropump according to the invention.
Figure 5B:
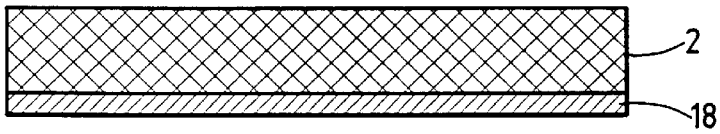
Figure 5C:
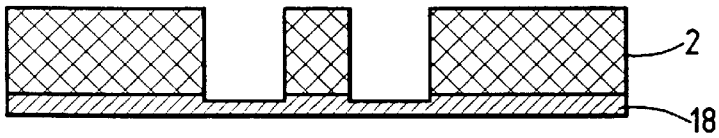
Figure 5D:
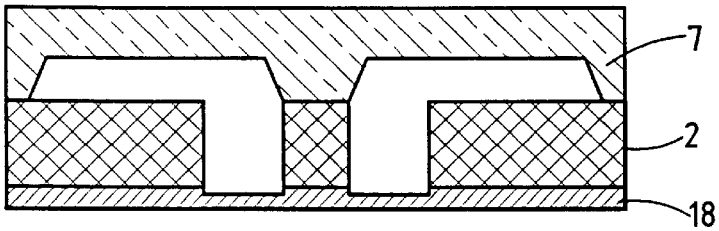
Figure 5E:
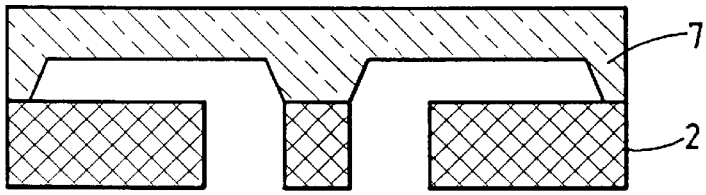
Figure 5F:
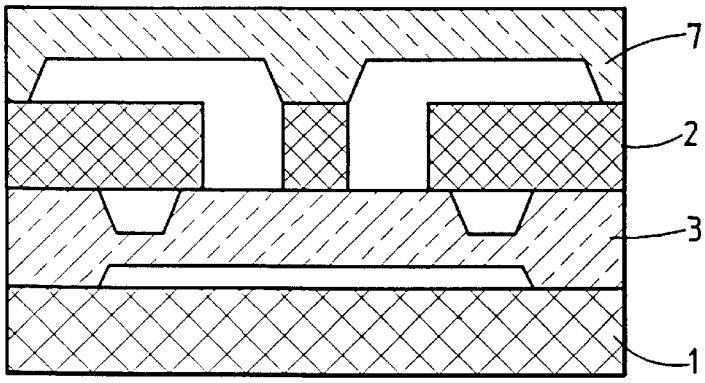

According to this third process of manufacture, the following steps are carried out:

a) deposit of a holding layer 18 on a face of the upper plate 2 (FIG. 5B), b) machining of the upper plate 2 on the face opposite the face in contact with the holding layer 18 so as to create the linking opening 12 and the intermediate part 13, the holding layer 18 also being able be be machined (FIG. 5C), but only partially, c) fastening of the actuating plate 7 on the face of the upper plate 2 which is opposite the face in contact with the holding layer 18 (FIG. 5D), d) removal of the holding layer 18 FIG. 5E), e) fastening of the upper plate 21actuating plate 7 assembly to the intermediate plate base plate 1 assembly (FIG. 5F), f) fastening of an actuation device, such as a piezoelectric one 6, to the actuating plate 7.

In this third process of manufacture, the holding layer 18 makes it possible to produce the linking opening 12 and the intermediate part 3 by machining in one single step, while allowing the upper plate 2 and the intermediate part 13 to remain quite aligned during the process of manufacture.

The holding layer is preferably a polymer or a metal and the plates constituting the micropump device are fixed together, as the case may be, by anodic welding.

The three processes of manufacture which have just been described are suitable for producing the first or the second embodiment of the micropump as shown in FIGS. 2 and 3.

In the case of the first embodiment of micropump shown in FIG. 2, in addition to the process steps mentioned above, a partial vacuum is preferably, but not necessarily, established within the tight space constituted by the cavity 8, the linking opening 12 and the intermediate cavity 14.

In the case of the second embodiment shown in FIG. 3, in addition to the process steps mentioned above, a conduit 15 is machined, linking the tight space formed by the cavity 8, the linking opening 12 and the intermediate cavity 14, this space being defined by the intermediate plate 3 and the actuating plate 7, to the outside of the micropump. Preferably, during fastening of the upper plate 2/actuating plate 7 assembly to the intermediate plate 3/base plate 1 assembly, the intermediate part 13 is fixed on the movable wall 5, for example by anodic welding.

What is claimed is:

1. A micropump for pumping and delivering a fluid, said micropump comprising at least one inlet, at least one outlet, one base plate, one upper plate having an initial thickness and provided with a first free face, an intermediate plate interposed between said base plate and said upper plate, and a pumping chamber between said base plate and said intermediate plate, said intermediate plate being made of a machinable material, said micropump further comprising at least one fluid inlet control member for connecting said pumping chamber with said inlet of the micropump, and at least one fluid outlet control member for connecting the pumping chamber with said outlet of the micropump, said intermediate plate comprising a movable wall machined in said intermediate plate in face of said pumping chamber and between said one fluid outlet control member and said one fluid outlet control member, said movable wall being adapted to move in two opposite directions during suction or delivery of said fluid in the pumping chamber, the upper plate being provided with one annular through hole facing at least one portion of said movable wall and an intermediate, said intermediate part and said upper plate being formed as one piece and being surrounded by said annular through hole, said micropump further comprising actuation means fixed on said first free face of said upper plate in face of said pumping chamber and being able to displace said movable wall in order to bring about a periodic variation of the volume of said pumping chamber, wherein the actuation means consists essentially of a single actuating plate, a single piezoelectric actuation device surmounting said actuating plate and said intermediate part, said actuating plate having an initial thickness, being made of a machinable material and being fixed to said first free face of said upper plate, said actuating place having a movable area defining with said upper plate an annular cavity and a central portion having said initial thickness of said actuating plate, said central portion of said actuating plate being surrounded by said annular cavity, said intermediate part facing and being fixed to said central portion of said actuating plate, said intermediate part having said initial thickness of said upper plate and being able to be in contact with said movable wall.

2. The micropump according to claim 1, wherein said intermediate part is fixed to said mobile wall.

3. The micropump according to claim 1, wherein said intermediate plate and said actuating plate define a tight space.

4. The micropump according to claim 3, wherein a partial vacuum is established within said tight space.

5. The micropump according to claim 2, wherein a conduit links said tight space with the outside of said micropump.

6. The micropump according to claim 1, wherein said micropump further comprises means for limiting displacement of said movable wall.

7. The micropump according to claim 1, wherein said actuation means are composed in particular of a piezoelectric device.

8. The micropump according to claim 1, wherein said base and upper plates are constituted of glass such as pyrex.

9. The micropump according to claim 1, wherein said intermediate and actuating plates are constituted of a metal or a semiconductor.

10. The micropump according to claim 1, wherein said actuation means, said intermediate part and said movable wall are centered about a same axis.

11. A process for manufacturing a micropump comprising the following steps:

providing an actuating plate with an initial thickness and a first free face;

machining said actuating plate from the opposite side of said free face to create an annular cavity facing a movable area of said actuating plate with a reduced thickness, said annular cavity surrounding a central portion of said actuating plate with said initial thickness, said actuating plate having a peripheral portion with said initial thickness and surrounding said cavity of said actuating plate;

providing an upper plate with a second free face and an initial thickness;

fastening the opposite side of said first free face of said actuating plate, by said central portion and said peripheral portion of said actuating plate, to said second free face of said upper plate so as to form an upper plate and actuating plate assembly;

machining the upper plate to create an annular through hole facing at least an inner portion of said cavity to create an intermediate part from the upper plate having said initial thickness, the intermediate part being surrounded by said annular through hole and facing said central portion of said actuating plate;

providing an intermediate plate/base plate assembly comprising a base plate and an intermediate plate superposed on said base plate;

fastening said upper plate and actuating plate assembly to said intermediate plate/base plate assembly by linking a face of said upper plate which is opposite to said actuating plate to a face of the intermediate plate which is opposite to said base plate; and fastening a piezoelectric actuation device to said first free face of the actuating plate.

12. The process according to claim 11, wherein the step of machining the linking opening in the upper plate comprises the step of electro-erosive machining.

13. A process for manufacturing a micropump comprising the following steps:

providing an actuating plate with an initial thickness and a first free face;

machining said actuating plate from the opposite side of said first free face so as to create an annular cavity facing a movable area of said actuating plate with a reduced thickness, said cavity surrounding a central portion of said actuating plate with said initial thickness, said actuating plate having a peripheral portion with said initial thickness and surrounding said annular cavity of said actuating plate;

providing an upper plate with a second free face and an initial thickness;

machining the upper plate only within a first part of the thickness of said upper plate to create a partial annular through hole within only a first part of the thickness of said upper plate, said partial annular through hole facing at least an inner portion of said annular cavity, to create an intermediate part from the upper plate having said initial thickness, the intermediate part being surrounded by said partial annular through hole and facing said central portion of said actuating plate;

fastening the opposite side of said first free face of said actuating plate, by said central portion and said peripheral portion of said actuating plate, to said second free face of said upper plate so as to form an upper plate and actuating plate assembly;

machining said upper plate within a second part of the thickness of said upper plate to terminate creation of said annular through hole and of said intermediate part;

providing an intermediate plate/base plate assembly comprising a base plate and an intermediate plate superposed on said base plate;

fastening said upper plate and actuating plate assembly to said intermediate plate/base plate assembly by linking a face of said upper plate which is opposite to said actuating plate to a face of the intermediate plate which is opposite to said base plate; and fastening a piezoelectric actuation device to said first free face of the actuating plate.

14. The process according to claim 13, wherein the step of machining the linking opening in the upper plate comprises the step of electro-erosive machining.

15. The process according to claim 13, wherein the step of machining the upper plate for termination of the creation of the linking opening and of the intermediate part comprises the step of chemical attack of the upper plate.

16. The process according to claim 13, wherein one or more metal layers are deposited on a face of the upper plate before starting the creation of the linking opening and of the intermediate part, the metal layer or layers being removed after having created the linking opening and the intermediate part.

17. The process according to claim 16, wherein the metal layer or layers are deposited on the face of the upper plate undergoing the partial creation of the linking opening and of the intermediate part.

18. The process according to claim 16, wherein the metal layer or layers are deposited on a face of the upper plate machined during termination of the creation of the linking opening and of the intermediate part.

19. The process according to claim 16, wherein a layer of chromium followed by a layer of copper are deposited.

20. The process for manufacturing a micropump comprising the following steps:

providing an upper plate with a first free face and an initial thickness;

depositing a holding layer on a face of said upper plate opposite to said first free face;

machining the upper plate from said first free face to create an annular through hole facing at least an inner portion of an annular cavity to create an intermediate part of the upper plate having said initial thickness, the intermediate part being surrounded by said annular through hole and facing said central portion of said actuating plate, the holding layer also being able to be partially machined from said first free face of said upper plate;

providing an actuating plate with an initial thickness and a second free face;

machining said actuating plate from the opposite side of said second free face so as to create the annular cavity facing a movable area of said actuating plate with a reduced thickness, said annular cavity surrounding a central portion of said actuating plate with said initial thickness, said actuating plate having a peripheral portion with said initial thickness, said actuating plate having a peripheral portion with said initial thickness and surrounding said annular cavity of said actuating plate;

fastening the opposite side of said second free face of said actuating plate, by said central portion and said peripheral portion of said actuating plate, to said first free face of said upper plate so as to form an upper plate and actuating plate assembly;

removing the holding layer;

providing an intermediate plate/base plate assembly comprising a base plate and an intermediate plate superposed on said base plate;

fastening said upper plate and actuating plate assembly to said intermediate plate/base plate assembly by linking a face of said upper plate which is opposite to said actuating plate to a face of the intermediate plate which is opposite to said base plate; and fastening a piezoelectric actuation device to said second free face of the actuating plate.

21. The process according to claim 18, wherein the holding layer is selected from a group consisting of a polymer and a metal.

22. The process according to claim 11, wherein the plates are fixed by anodic welding.

23. The process according to claim 11, wherein, during fixation of the upper plate/actuating plate assembly to the intermediate plate/base plate assembly, the intermediate part is fixed on a movable wall.

24. The process according to claim 21, wherein a conduit is machined, linking a tight space defined by the intermediate plate and the actuating plate with an outside of the micropump.

25. The process according to claim 11, wherein a partial vacuum is established within the tight space.

* * * * *